United States Patent [19]

Oehmig

[11] 4,213,275

[45] Jul. 22, 1980

[54] THRESHOLD AND DOOR SEALING STRUCTURE

[76] Inventor: Robert G. Oehmig, 1921 NE. 150th St., N. Miami, Fla. 33181

[21] Appl. No.: 25,898

[22] Filed: Apr. 2, 1979

[51] Int. Cl.[2] ..... E06B 1/70

[52] U.S. Cl. ..... 49/468; 49/469

[58] Field of Search ..... 49/468, 469, 482, 499

[56] References Cited

U.S. PATENT DOCUMENTS

| | | | |
|---|---|---|---|
| 2,849,763 | 9/1958 | Leigh | 49/469 |
| 2,933,781 | 4/1960 | Cornell | 49/469 X |
| 3,142,097 | 7/1964 | Oehmig | 49/469 X |
| 3,148,419 | 9/1964 | Straus et al. | 49/469 |
| 3,475,866 | 11/1969 | Johansen | 49/468 |

*Primary Examiner*—Philip C. Kannan

*Attorney, Agent, or Firm*—McWilliams, Mann & Zummer

[57] ABSTRACT

A threshold and door sealing structure combining a rigid threshold member and a relatively flexible sealing member secured to the threshold member along one side edge and extending upwardly and over the threshold member in spaced relation thereto and downwardly over a depending flange at one side of the threshold member with the sealing member secured to the depending flange and vertically adjustable relative to such flange.

5 Claims, 4 Drawing Figures

THRESHOLD AND DOOR SEALING STRUCTURE

BACKGROUND OF THE INVENTION

1. Field of the Invention

The present invention pertains to sealing arrangements for the bottom edge of a door which resiliently engages the bottom edge of the door to close the space therebeneath while permitting sufficient flexing of the sealing member to enable the door to engage and disengage the sealing member when the door is opened and closed and which restores itself to normal position when disengaged.

2. Description of the Prior Art

Numerous threshold sealing arrangements are available in the prior patent art but none of these provides for vertical adjustment of the sealing member relative to the threshold in a positive manner. Some utilized spring arrangements to compensate for wear resulting from long use, or deterioration of the sealing member. Others utilized excessive mass in the resilient member to afford long life while others provided an excessive arch in the sealing member for similar purposes.

Nowhere does the prior patent art reveal a threshold sealing arrangement where the sealing member is secured at one edge and extends up and over the threshold and at the opposite side is secured to a vertical side of the threshold by fastening arrangements which allow vertical adjustment of the sealing member. Typical of prior sealing arrangements at door thresholds are early U.S. Pat. Nos. 100,461 of Mar. 1, 1870, 794,424 of July 11, 1905, 2,102,578 of Dec. 14, 1937 and 2,718,677 of Sept. 27, 1955.

SUMMARY OF THE INVENTION

This invention provides an effective door seal, especially at the threshold, wherein a rigid threshold member is used in combination with a flexible, or resilient sealing member. The rigid threshold member includes an upwardly facing top surface having at least one undercut groove adjacent to a side thereof and a depending supporting flange adjacent to an opposite side of the threshold. A curved flange extending outwardly and downwardly from adjacent the undercut groove, engages a supporting surface at that side of the threshold. The sealing member includes a lateral flange at one side, secured in the undercut groove and extending upwardly and over the top of the threshold in spaced relation to the top surface thereof and thence downwardly over the outside face of the depending supporting flange. Where the sealing member engages over the outside face of the supporting flange it is of substantial thickness relative to the remaining portion of the member overlying the threshold top surface and is provided with vertically extending slots for the fastening members whereby the thickened wall may be adjusted vertically on the threshold member and thereby raise, or lower, the portion of the sealing member disposed over the top surface of the threshold, thus adjusting the sealing member relative to a door operating relative to this threshold arrangement so that the sealing member can be adjusted for wear and tear, or normal deterioration.

OBJECTS OF THE INVENTION

The primary purpose of the invention is to provide a door threshold sealing arrangement affording vertical adjustment to compensate for wear, or deterioration of the sealing member.

The principal object of the invention is the provision of a threshold arrangement comprised of a rigid threshold member and a resilient, or flexible, sealing member fixed to the threshold at one side and vertically adjustable relative thereto at the other side.

An important object of the invention is to provide a rigid threshold member having an undercut groove adjacent one side thereof and a depending supporting flange at the other side with a flexible sealing member secured in the undercut groove and extending over the threshold in spaced relation and downwardly over the supporting flange with securing means therefor that enables the sealing member to be adjusted vertically on the supporting flange.

Another object of the invention is the provision of a threshold arrangement comprised of a rigid threshold member and a flexible sealing member wherein the sealing member is fixed to the threshold member at one edge and extends downwardly over the threshold at the opposite side with fastening means allowing vertical adjustment at this side and having an outstanding flange on the sealing member for effecting such adjustment.

A further object of the invention is to provide a threshold sealing arrangement comprised of a rigid threshold member and a flexible sealing member adjustably mounted on the threshold at one side and having a flange at the other side secured in an undercut groove on the threshold with an outstanding lip on the sealing member overlying the undercut groove.

A still further object of the invention is the provision of a rigid threshold member in combination with a flexible sealing member wherein the sealing member is adjustably mounted on a vertical supporting flange of the threshold at one side and secured under an undercut groove on the threshold at the other side with a curved flange extending outwardly and downwardly from adjacent such undercut groove to engage a supporting surface.

DESCRIPTION OF THE DRAWINGS

The foregoing and other and more specific objects of the invention are attained by the structure and arrangement illustrated in the accompanying drawings wherein FIG. 1 comprises a general perspective view in cross section illustrating the threshold member and associated sealing member.

DESCRIPTION OF PREFERRED EMBODIMENT

Figure 1:
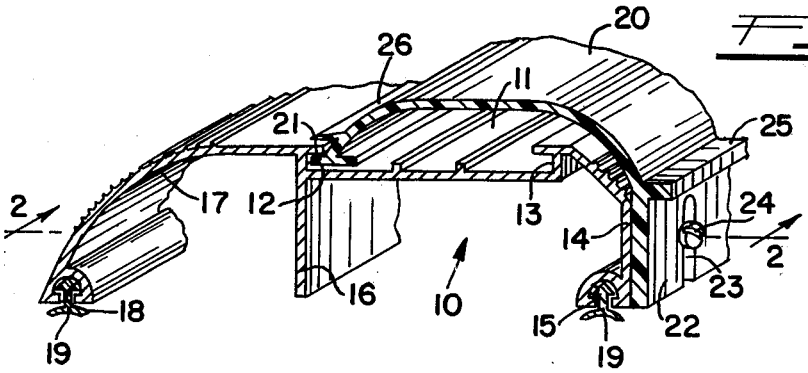
Figure 2:
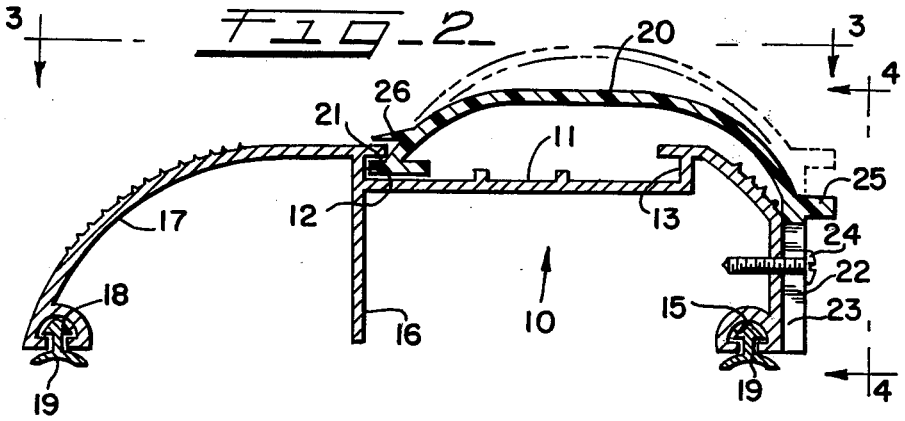
FIG. 2 is a view in transverse cross section through the threshold and sealing member.
Figure 3:
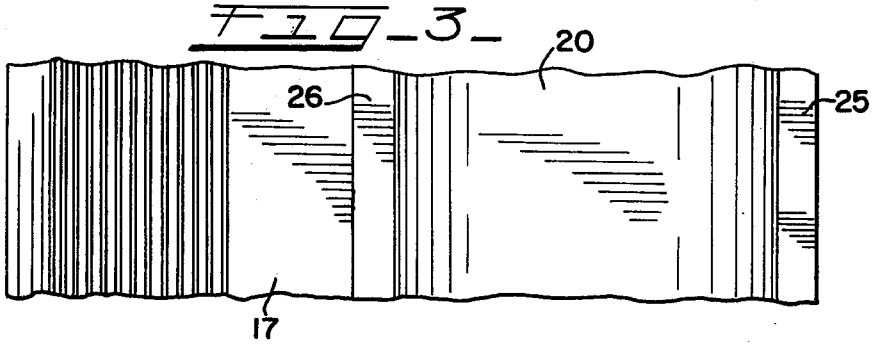
FIG. 3 is fragmentary plan view of the threshold and sealing member.
Figure 4:
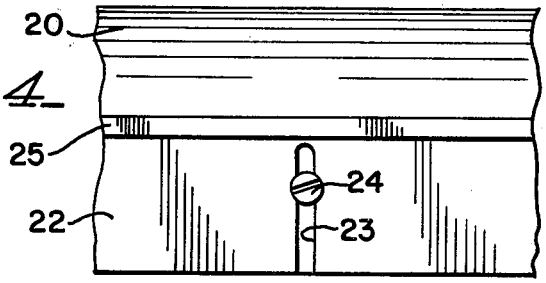
FIG. 4 is an elevational view looking at a fragment of the inner side of the sealing member.

In the drawings, 10 represents a rigid threshold member which may be made from metal such as extruded aluminum, or it might be made from a suitable plastic material that could also be extruded. The threshold 10 includes an upwardly facing top surface 11, the width of which is defined by an undercut groove 12, and a groove 13 at respectively opposite sides. Adjacent to the groove 13 the threshold extends outwardly and then terminates in a depending supporting flange 14 and at its bottom this flange has a dovetail groove 15 for the reception of caulking, or a sealing member 19 where the flange bears on a supporting surface (not shown).

Adjacent to the undercut groove 12 the threshold is provided with a vertical depending flange 16 which also engages the supporting surface and more or less coincident with the level of this undercut groove an outwardly extending flange 17 is curved downwardly and terminates in a dovetail groove 18 which also is adapted to receive a caulking material, or a resilient sealing strip 19 whereby the threshold 10 is effectively sealed at each side relative to the supporting surface.

Overlying the rigid threshold member 10 is a resilient sealing member 20, made preferably in one piece of a suitable material having the desired flexibility such as a plastic vinyl, which completely covers the threshold top surface 11 from the undercut groove 12 to the depending flange 14, to which it is secured. The member 20 has a foot at one edge including an outwardly directed flange 21 that is secured in the undercut groove 12. From the foot 21 the sealing member extends up and over the top surface 11 on a more or less continuous curve in spaced relation above the threshold member and terminates in a depending flange, or wall 22, which is vertically disposed and in engagement with the vertical flange 14 of the rigid threshold member.

It should be noted that the vertical wall 22 is considerably thicker than the curved portion of the sealing member so that it is relatively stiffer than the curved portion. The relatively stiff wall 22 is provided with spaced vertical slots 23 at intervals for the insertion of fastening members 24 which are threaded into preformed openings in the vertical flange 14 of the threshold member. By means of these slots the sealing member wall 22 may be adjusted vertically on the flange 14 merely by loosening the fastenings 24, adjusting the wall 22 either upwardly or downwardly and then tightening the fastenings.

This vertical adjustment of the sealing member wall 22 is provided at the inner side of a related door and is facilitated by the provision of an outstanding integral flange 25 on the wall, which is disposed adjacent to the top thereof so that is is in an easy position to be grasped manually to pull the wall 22 upwardly, or to push it downwardly, as desired. By adjusting the integral wall 22 up or down, it will readily be seen that the curved upper portion of the sealing member 20 will be raised or lowered a corresponding amount so that if the sealing member deteriorates, or wears, or the door with which it is associated shrinks, an adjustment can quickly be made without removing the door or the sealing member, to bring the operative relationship between the member 20 and a related door back to normal.

The sealing member 20 at the one side where it engages in the groove 12, is provided with an overhanging lip 26 which extends outwardly from the sealing member and overlies the undercut groove and the joint between the edge of the rigid threshold member and the sealing member, so that any possibility of weather getting into the joint at this point is precluded. It is intended that the outwardly and downwardly curved extension 17 of the rigid threshold is to be disposed outwardly of the door and the vertical flange 14 and related wall 22 secured thereto, are disposed at the inner side of the door. The height of the inwardly facing wall 22 and the inwardly directed flange 25 are designated to be such as to cooperate with a carpet installation, or rug, or other type of floor application without creating an obstruction in the doorway.

The sealing member 20 has been described herein as being related to a threshold at the bottom of a door but it is apparent that the sealing arrangement might be utilized at any of the other sides of a door for sealing the door opening very effectively.

From the foregoing it will be seen that there has been provided a threshold structure comprised of a rigid threshold member and a flexible sealing member combined in a manner to provide a sealing arrangement between the threshold and a related door which may readily be adjusted to restore a normal relationship between the seal and door when the seal may require adjustment after a period of service.

What is claimed is:

1. A threshold and door sealing structure including a substantially rigid threshold member and a relatively flexible sealing member, said threshold member having at least one undercut groove adjacent a top surface thereof and at least one depending flange, said flange being located at one side of the threshold member spaced from said groove, said sealing member having a flange along one edge thereof secured in said undercut groove, said sealing member extending upwardly and over the threshold member and downwardly over said depending flange, fastening members securing the sealing member to said depending flange, the sealing member being vertically adjustable relative to said fastenings, the portion of the sealing member extending downwardly over said depending flange comprising a vertical wall of substantially greater thickness than the portion extending over the threshold member and of substantially greater stiffness than such last-named portion, and an outstanding flange on said vertical wall adjacent the top thereof.

2. A threshold and door sealing structure as set forth in claim 1 wherein said vertical wall is provided with vertically extending slots at said fastenings, said slots providing for the sealing member being vertically adjustable.

3. A threshold and door sealing structure as set forth in claim 1 wherein said rigid threshold member includes a depending flange adjacent to the location of said undercut groove.

4. A threshold and door sealing structure as set forth in claim 1 wherein said member includes an outstanding lip overlying said undercut groove.

5. A threshold and door sealing structure as set forth in claim 4 wherein said threshold member includes a curved outwardly and downwardly extending flange from adjacent said undercut groove.

* * * * *